United States Patent [19]

Hasegawa et al.

[11] 4,014,031

[45] Mar. 22, 1977

[54] ELECTROPHOTOGRAPHIC TYPESETTING METHOD AND APPARATUS THEREFOR

[75] Inventors: Shigeru Hasegawa, Yokohama; Katsuyoshi Takai, Fujimi; Hiroharu Yamazaki; Sueo Kikkawa, both of Tokyo; Eizo Suyama, Hayama, all of Japan

[73] Assignees: Sakata Shokai Ltd.; Tokyo Broadcasting System, Inc., both of Tokyo, Japan

[22] Filed: Aug. 29, 1975

[21] Appl. No.: 609,041

[30] Foreign Application Priority Data

Mar. 28, 1975 Japan ..... 50-37657

[52] U.S. Cl. ..... 354/5; 354/3

[51] Int. Cl.[2] ..... B41B 13/00; B41B 21/24

[58] Field of Search ..... 354/3–6, 354/14

[56] References Cited

UNITED STATES PATENTS

| | | | |
|---|---|---|---|
| 3,528,355 | 9/1970 | Blackert | 354/3 |
| 3,693,517 | 9/1972 | Clark | 354/3 |
| 3,703,137 | 11/1972 | Anderson et al. | 354/5 |
| 3,705,543 | 12/1972 | Rees | 354/3 |
| 3,736,855 | 6/1973 | Cuenca | 354/3 |
| 3,788,203 | 1/1974 | Rhodes | 354/3 |

OTHER PUBLICATIONS

I.B.M. Technical Disclosure, p. 1845., Bulletin, vol. 10, No. 12, May 1968, Electrophotographic Apparatus.

*Primary Examiner*—Donald A. Griffin

*Attorney, Agent, or Firm*—McNenny, Pearne, Gordon, Gail, Dickinson & Schiller

[57] ABSTRACT

A method and apparatus for making monocolor prints in a desired color wherein a web of photoconductive material is supplied as a photosensitive material, a desired length of segment is sheared from said web of photoconductive material, said material segment is electrically charged, the charged material is exposed by a phototypesetting machine to light through desired characters, numerals and/or other symbols in an original plate of said machine, and said exposed material is developed by the use of electrophotographic toner having a desired color.

2 Claims, 3 Drawing Figures

ELECTROPHOTOGRAPHIC TYPESETTING METHOD AND APPARATUS THEREFOR

BACKGROUND OF INVENTION

This invention relates to a method for making monocolor prints having a desired color and apparatus for carrying out the method and, more particularly, to a method adapted to be useful for making a small number of prints in a short time for urgent requirement.

For instance, the so-called title cards, bearing characters, numerals and/or other symbols, which are employed in television broadcasting and the like are frequently employed in rapid reporting of news and commercial advertisements and so, in such a case it is necessary to make them in a short time. And in color television broadcasting, it is usually required to make monocolor title cards. In conventional methods for making prints such as title cards, drawings freehandly drawn out by a skilled designer, or prints or slides by photographic process, or printed matters by printing process are employed for such prints.

When the drawings as referred above are employed, it needs a skilled designer, and it is usually impossible for the designer to draw out the drawings in a short time. When used with photographic process, a photographic film is exposed to light reflected from an original manuscript by photographic apparatus and the film is developed to produce a transparency, and then a photographic paper is exposed to light through the transparency to produce a print, or the transparency is used directly as a slide. Accordingly, in this method, the original manuscript is always needed and, thus, it is necessary to make it consuming a lot of time therefor. Further, when it is needed to prepare color prints or slide by this method, a large scale developing device and skilled persons therefor are required.

Alternatively when a phototypesetting machine is employed, a photographic film or a photographic paper is directly exposed to light through desired or selected characters, numerals and/or other symbols in the original glass plate of the machine, and the film or paper is developed to produce a transparency or a photographic print. Among the above-mentioned conventional methods for making prints, the method using a phototypesetting machine is most frequently employed because the method has advantages over the other conventional methods in that the step of forming the original manuscript by a skilled designer can be eliminated, and anyone can directly make the transparency or the photographic print in a short time. However in this method, it is not possible to make a monocolor print or slide having a desired color.

Even when the method using a printing machine is employed, it is required to prepare an original manuscript and to make a printing plate based on the manuscript and, thus, the method needs a skilled person and a lot of time therefor.

As apparent from the above, conventional methods for making prints such as title cards consume a lot of time, labor and expense, and they are unsuitable for making monocolor prints having a desired color in a short time for urgent requirement.

SUMMARY OF INVENTION

The present invention provides a novel and improved method and apparatus for making monocolor prints which can effectively eliminate the difficulties inherent in the conventional methods referred to above.

One object of the present invention is to make monocolor prints having a desired uniform and fine color in a simple manner and short time by the employment of the electrophotography using various color toners.

Another object of the present invention is to reduce production cost per print by eliminating the step of preparing a transparency which is necessary in the conventional methods for making prints.

According to the present invention, in making a print such as a title card, photoconductive material is employed as the photosensitive material, the photoconductive material is exposed by phototypesetting machine to light through desired or selected characters, numerals and/or other symbols in the original glass plate of the phototypesetting machine and the photoconductive material bearing latent images of the characters, numerals and/or other symbols is developed with an electrophotographic toner of desired color. Therefore, the present invention can eliminate the time and labor required for preparing an original manuscript necessary in the conventional methods for making prints and thus, the present invention can make monocolor prints having a desired color in a quite simple manner and short time. Therefore, the present invention is quite effective in making prints such as title cards which are usually required to be made quickly to meet emergency demand. Particularly, when monocolor prints having a desired color are made, the present invention occupies only a small floor space and eliminates the large scale developing device required in the conventional methods for making prints having a desired color using a photographic film or paper as the photosensitive material.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

DESCRIPTION OF PREFERRED EMBODIMENT

Figure 1:
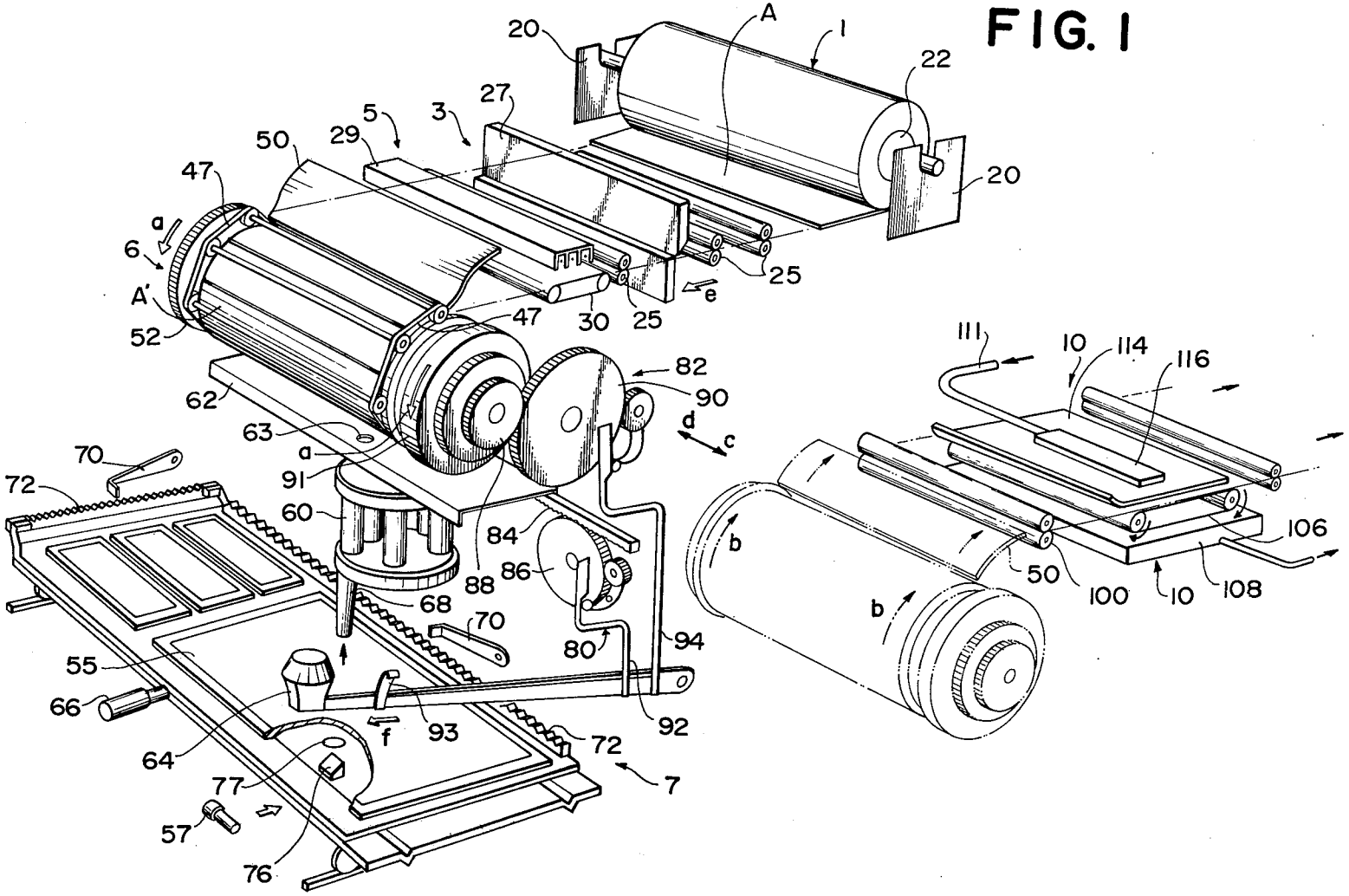
FIG. 1 is an isometric perspective view schematically showing one preferred embodiment of print making apparatus constructed in accordance with the present invention.

Referring now to the accompanying drawings and more particularly, to FIG. 1 thereof, there is schematically shown one preferred embodiment of print making apparatus of the invention. The print making apparatus generally comprises a photoconductive material supply device 1 for feeding photoconductive material A in the form of a web sheet into the apparatus, a shearing device 3 for shearing a predetermined length of segment from the rest of the material A fed from the supply device 1, a charging device 5 for electrically charging the material segment A′, a photoconductive material holding device 6 for holding the charged material segment A', an image exposing device 7 for exposing the charged material segment to light for producing latent images of selected or desired characters, numerals and/or other symbols thereon and a developing device 10 for developing the material segment A' fed from the exposing device 7.

The photoconductive material supply device 1 includes a roll of sheet like photoconductive material A wound about a rotary shaft 22 which is in turn journalled at the opposite ends in a pair of opposite and spaced upright frames 20, 20. The photoconductive material A has been prepared by, for examle, grinding a mixture comprising 10 parts by weight of zinc oxide and 2 – 7 parts by weight of alkyd resin in a ball mill for about 6 to 10 hours and uniformly applying the ground mixture onto a sheet-like base material such as a paper.

The photo-conductive material A is paid out of the roll on the shaft 22 and fed at a predetermined rate to and into the shearing device 3 by means of a series of feed rollers 25 in pairs which are driven by a drive motor (not shown). In the illustrated embodiment, the photoconductive material A is preferably fed at a rate within the range from 50 mm to 200 mm/sec.

When a predetermined length of the photoconductive material A has passed through the upper and lower blades 27 in the shearing device 3, the driving of the feed rollers 25 is stopped and the upper blade of the pair of shearing blades 27 is allowed to fall down to shear the predetermined length portion from the rest of the photoconductive material A in cooperation with the lower shearing blade.

Figure 2:
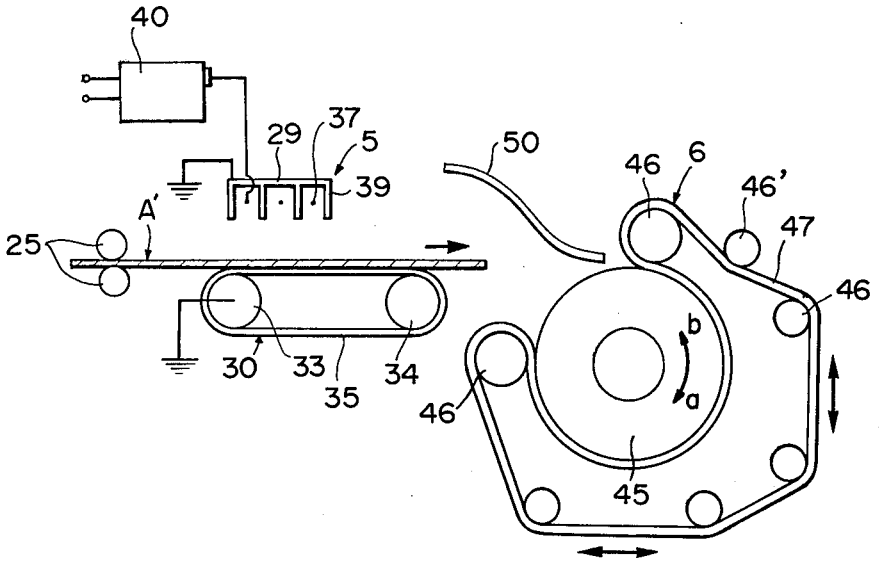
FIG. 2 is a fragmentary schematic view in side elevation of the charging device and photoconductive material in the apparatus as shown in FIG. 1.
Figure 3:
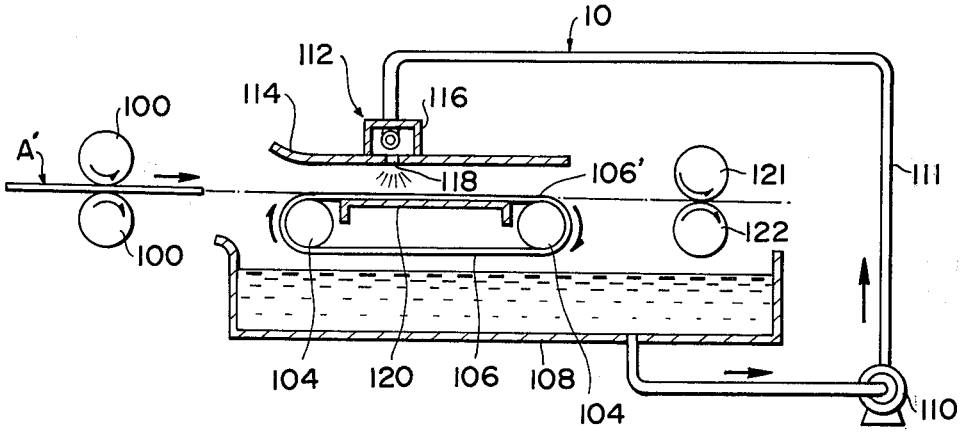
FIG. 3 is a fragmentary schematic view in side elevation of the developing device and squeeze rollers in the apparatus as shown in FIG. 1.

After the predetermined length portion or segment A' has been sheared from the rest of the photoconductive material A, the feed rollers 25 are again driven and the sheared material portion or segment is fed to and into the electrically charging device 5 by the last pair of feed rollers 25 which are positioned at the downstream of the blades 27 in the path of the material A. As seen in FIG. 2, the charging device 5 includes charging means 29 and photoconductive material supporting means 30. The photoconductive material supporting means 30 includes a pair of opposite and spaced rotary rollers 33 and 34 which are driven by drive means (not shown) and an endless belt 35 trained about the rollers and the sheared photoconductive material segment A' is charged to 300 to 1000 V as the material segment is carried underneath the charging means 29 while being supported on the moving belt 35. The charging means 29 includes fine corona wire electrodes 37 formed of tungsten, stainless metal or the like and a grounded shielding case 39 surrounding the electrodes 37 and formed of aluminum, stainless metal or the like. The electrodes 37 are applied thereto a potential within the range of from −5 KV to −10 KV. The above-mentioned rotary rollers 33, 34 and belt 35 are formed of metal and also grounded. In order to uniformly charge the photoconductive segment A', more than two fine corona wire electrodes 37 are preferably employed and usually several corona electrodes are employed. When the distance of the fine corona wire electrodes from the photoconductive material segment A' is set within the range 10 to 20 mm, a satisfactory result can be obtained.

The charged photoconductive material segment A' is then fed to and into the material holding device 6 which, in the illustrated embodiment as shown in FIGS. 1 and 2, includes a rotary drum 45, a pair of endless belts 47, 47 spaced away from each other in the axial direction of said drum and partially trained around the outer peripheries of the opposite ends of the drum by means of a plurality of pulleys 46, 46 . . . disposed about the drum adjacent to the opposite ends thereof so that the portions of the belts engage with the outer peripheries above, and, a photoconductive material receiving-discharging guide 50. An electromagnetic clutch 52 is provided at one end of the rotary drum 45 (the left-hand end as seen in FIG. 1) and when the material segment A' is fed into the holding device 6 by the last pair of feed rollers 25, the electromagnetic clutch is energized in synchronization with the feeding operation of the rollers so as to drivingly connect the drum 45 to drive means (not shown) to rotate the drum in the arrow direction *a* as seen in FIG. 1 at a peripheral speed corresponding to the feeding speed of the photoconductive material segment A' by means of the rollers. As the drum 45 rotates in the manner mentioned just above, the belts 47, 47 also rotate in the same direction and at the same speed as those of the drum whereby the photoconductive material segment A' guided by the guide 50 is pinched between the rotating drum and belts 47, 47 to be partially wound about the drum. When the photoconductive material segment A' reaches a predetermined position in the periphery of the drum 45 as the material segment is wound about the latter, the electromagnetic clutch 52 is deenergized to thereby terminate the rotation of the drum 45 and belts 47, 47 leaving the photoconductive material segment A' on the drum 45. The belts 47, 47 preferably have a width within the range 5 – 20 mm and are formed of rubber or synthetic resin. In order to adjust the tension of the belts 47, 47, a tension adjusting pulley 46' is preferably provided adjacent to each of the belts 47, 47. The photoconductive material holding device 6 is not limited to the use of the rotary drum 45 and instead may be designed to hold the photoconductive material segment A' plane. The plane-type holding device is more convenient than the rotary drum-type holding device because the plane-type device makes it easy to take the focus throughout the photoconductive material segment A' in exposure for producing latent images of characters, numerals and/or other symbols onto the material segment.

While the photoconductive material segment A' is being held on the stationary holding drum 45, the segment is exposed by exposing device 7 so as to produce latent images of desired or selected images thereon, the exposing device 7 being similar to the so-called phototypesetting machine. That is, the image exposing device 7 includes a movable original glass plate 55, a lamp 57 for applying light beams to the glass plate and a lens turret 60 for focusing the light beams which are emitted from the lamp 57 and applied through the original glass plate 55 onto the photoconductive material segment A'. The lens turrent 60 is fixedly secured to a support frame 62 on which the holding device 6 is mounted for sliding movement in the axial direction of the holding drum 45. In the operation of the image exposing device 7, in the same manner as followed in the conventional phototypesetting machine, an operation lever 64 pivoted to the above-mentioned support frame 62 and an operation bar 66 fixedly secured to the original plate 55 are manipulated so as to bring desired or selected characters, numerals and/or other symbols on the original glass plate 55 to the position just below an object lens 68 projecting downwardly from the lens turret 60, the lever 64 is then depressed by a predetermined amount to cause the original glass plate positioning levers 70, 70 to engage the racks 72, 72 on the glass plate 55 so as to hold the glass plate in position, and the lever 64 is then further depressed down to light the lamp 57 whereby the images of desired or selected characters, numerals and other symbols are projected onto the photoconductive material segment A' through a mirror 76, a lens 77, the original plate 55, the lens turret 60 and a through hole 63 in the support frame 62. The holding device 6 further includes a transverse carriage mechanism 80 for carrying the holding device in the axial direction of the holding drum 45 (transverse with respect to the path of the material segment A') and a longitudinal carriage mechanism 82 (with respect to the path of the material segment A') for rotating the holding drum 45 in the arrow direction *b*. The transverse carriage 80 includes a rack 84 which is mounted on the support frame 62 for sliding movement in the axial direction of the drum 45 with respect to the suppot frame 62 and fixedly secured to the drum 6 and tranverse feed gear means 86 in meshing with the rack 84. The longitudinal carriage mechanism 82 includes a longitudinal feed gear means 90 in mesh with a gear 88 loosely and coaxially mounted at one end of the shaft for the holding drum 45. An electromagnetic clutch 91 is mounted on the shaft for the holding drum 45 between the drum 45 and gear 88 and the electromagnetic clutch 91 is adapted to be energized to rotate the gear 88 and drum 45 in unison when the first mentioned electromagnetic clutch 52 mounted at the other end of the shaft is deenergized or the material segment A' is held in a predetermined position on the drum 45 as mentioned above. The transverse feed gear means 86 and longitudinal feed gear means 90 are operatively connected to a change-over lever 93 slidably mounted on the operation lever 64 through connection rods 92 and 94, respectively. In the position as shown in FIG. 1, the transverse feed gear means 86 is in its energized condition while the longitudinal feed gear means 90 is in its deenergized condition. With the transverse feed gear means 86 and longitudinal gear means 90 in the positions described just above, as the operation lever 64 is depressed, the transverse feed gear means 86 is operated to transversely shift the holding device 6 by a predetermined number of pitches whereupon the above-mentioned image exposing operation is carried out. On the other hand, when the change-over lever 92 is pulled in the arrow direction *f* as seen in FIG. 1, the transverse feed gear means 86 is rendered inoperative while the longitudinal feed gear means 90 is rendered operative. With the transverse feed gear means 86 and longitudinal feed gear means 90 in the positions described just above, as the operation lever 64 is depressed, the drum 45 is rotated by a predetermined number of pitches in the arrow direction *b*. Therefore, by the operation of the transverse and longitudinal carriage mechanisms 80, 82, the images of desired or selected characters, numerals and/or other symbols are projected onto the photoconductive material segment A' in a suitably selected position thereof.

After the exposing operation has been completed, the transverse carriage mechanism 80 is operated to move the holding device 6 in the arrow direction *c* to the phantom line position in FIG. 1. In this position, the second electromagnetic clutch 91 is deenergized and the first electromagnetic clutch 52 is energized to rotate the holding drum 45 and holding belts 47, 47 in the arrow direction b as seen in FIGS. 1 and 2 in response to the reversion of the drive means (not shown) operatively connected to the clutch 52. The rotation of the drum 45 and belts 47, 47 in the arrow direction b removes the photoconductive material segment A' which now bears the exposed images thereon from the drum 45 and feeds the segment A' along the guide 50 to and between a pair of upper and lower pick-up rollers 100 which in turn feed the photoconductive material segment A' to and into the developing device 10. The pick-up rollers 100 are preferably in the form of highly insulative rubber rollers so that the latent images formed on the photoconductive material segment A' will not be destroyed or damaged.

The developing device 10 includes an endless belt 106 which is trained about and driven by a pair of opposite pulleys 104, 104 which are in turn driven by drive means (not shown) so as to transport the material segment A' thereon, a developer sump 108 positioned below the pulleys 104, 104 and belt 106 and developer supply means 112 positioned above the pulleys 104, 104 and belt 106 for receiving developer from the sump 108 through a supply tube 111 by means of a pump 110 and applying the developer onto the photoconductive material segment A'. The developer supply means 112 includes a substantially horizontal developing electrode plate 114 and a developer vessel 116 mounted on the electrode plate 114. The electrode plate 114 is provided with a slit 118 having a width ranging from 1.0 to 3.0 mm through which the developer from the developer vessel 116 drips onto the material segment A'. Any excess developer not used for developing the latent images is received into the developer sump 108 for recirculation. The electrode plate 114 is preferably formed of aluminum or stainless metal and grounded. A support plate 120 is positioned below the upper run 106' of the belt 106 and preferably maintained in parallel to the developing electrode plate 114 in a spaced relation thereto at a distance within the range from 1.0 to 3.0 mm therefrom. It was found that when the feed rate of the developer is within the range from 2000 to 4000 ml per minute and the rotation rate of the belt 106 is within the range from 10 to 30 mm per second satisfactory results are obtained.

For the developers of the photoconductive material, conventional electrophotographic toners may be used. For example, a black color developer may be prepared by mixing 1 part by weight of paste comprising 10 parts by weight of carbon black and 40 parts by weight of polystyrene varnish with 300 parts by weight of n-paraffine and a blue color developer may be prepared by 1 part by weight of paste comprising 10 parts by weight of phthalocyanine Blue and 40 parts by weight of soybean oil modified short oil alkyd resin with 300 parts by weight of mineral spirit.

The developed photoconductive material segment A' is then fed to squeeze roller means including an upper metallic roller 121 and a lower rubber roller 122 which cooperate with each other to remove any excess developer from the material segment A' while the segment is passing between these rollers. After the excess developer has been removed therefrom, the photoconductive material segment A' assumes a substantially dry condition. It was found that when the rollers 121 and 122 are subjected to a load within the range from 200 to 500 g per 100 mm, a satisfactory result is obtained.

After the excess developer removal step, the holding device 6 is moved or returned in the arrow direction d to the original position to thereby complete one cycle of operation.

In the embodiment described hereinabove, the developing device is shown as a liquid developer device, but the developing device may be a dry-type developing device.

In the embodiment illustrated and described, it takes about 3 to 10 minutes to obtain a desired print. Thus, the present invention is quite useful in the making of a title card for television news and the like which should be produced in a very short time.

The invention has been described in detail with particular reference to the preferred embodiment thereof, but it will be understood that variations and modifications can be effected within the spirit and scope of the invention.

What is claimed is:

1. An apparatus for making prints comprising:

an electrically charging device for electrically charging a photoconductive material, a photoconductive material holding device for holding said electrically charged material; and an image exposing device having a phototypesetting machine adapted to expose said charged material to light through desired characters, numerals and/or other symbols in the original plate of said phototypesetting machine, said photoconductive material holding device including a rotary holding drum about which said electrically charged photoconductive material is disposed in position and held at the opposite side edges of the material in the axial direction of said drum, said photoconductive material holding device also including a pair of endless belts spaced away from each other in the axial direction of said drum, each of said belts being partially trained around the corresponding outer periphery of said drum, the engaging faces of said belts with said outer peripheries being driven at the same rate and in the same direction as those of said outer peripheries of said drum whereby when an electrically charged photoconductive material is fed onto the holding drum, the material is pinched between the rotating drum and holding belts so that the material is held at the opposite side edges thereof on the holding drum.

2. An apparatus for making prints comprising:

an electrically charging device for electrically charging a photoconductive material, a photoconductive material holding device for holding said electrically charged material; and an image exposing device having a phototypesetting machine adapted to expose said charged material to light through desired characters, numerals and/or other symbols in the original plate of said phototypesetting machine, said apparatus also including a photoconductive material supply device holding a roll of a continuous length of photoconductive material and paying out said material from the roll;

a shearing device for shearing a desired length segment from the rest of the paid out material from said supply device and feeding said sheared segment of the material to said electrically charging device; and a developing device for developing said sheared and electrically charged segment of material by means of a desired color toner after the material segment has had latent images exposed thereon.

* * * * *